US007918032B2

(12) United States Patent
Zaremski

(10) Patent No.: US 7,918,032 B2
(45) Date of Patent: Apr. 5, 2011

(54) RULER WITH ABRASIVE EDGE

(75) Inventor: Mark A. Zaremski, Downers Grove, IL (US)

(73) Assignee: Sullivans USA

( * ) Notice: Subject to any disclaimer, the term of this patent is extended or adjusted under 35 U.S.C. 154(b) by 0 days.

(21) Appl. No.: 12/774,906

(22) Filed: May 6, 2010

(65) Prior Publication Data

US 2011/0010955 A1 Jan. 20, 2011

Related U.S. Application Data

(63) Continuation-in-part of application No. 12/643,416, filed on Dec. 21, 2009, now abandoned.

(60) Provisional application No. 61/225,413, filed on Jul. 14, 2009.

(51) Int. Cl.
*B43L 7/00* (2006.01)

(52) U.S. Cl. ..... 33/492

(58) Field of Classification Search ..... 33/492, 33/483, 484, 485
See application file for complete search history.

(56) References Cited

U.S. PATENT DOCUMENTS

| | | | | |
|---|---|---|---|---|
| 180,521 | A | 8/1876 | Beach | |
| 418,870 | A | 1/1890 | Hazlett | |
| 591,804 | A | 10/1897 | Barrie | |
| 1,115,101 | A * | 10/1914 | Penn | 33/492 |
| 1,643,295 | A | 9/1927 | Crump | |
| 2,182,028 | A * | 12/1939 | Little et al. | 33/490 |
| 2,509,559 | A * | 5/1950 | Cardinell | 33/492 |
| 3,991,922 | A * | 11/1976 | Martin | 225/17 |
| 4,490,921 | A * | 1/1985 | Woods et al. | 33/476 |
| 4,524,522 | A * | 6/1985 | Perry | 33/11 |
| 5,056,273 | A | 10/1991 | Martel | |
| 5,317,839 | A | 6/1994 | Anderson | |
| 5,471,749 | A * | 12/1995 | Brady | 33/484 |
| 5,471,755 | A * | 12/1995 | Haskell | 33/485 |
| 5,569,064 | A | 10/1996 | Gleadall | |
| 5,749,153 | A | 5/1998 | Viens | |
| 5,791,062 | A | 8/1998 | Walker | |
| 5,842,402 | A * | 12/1998 | Collier | 83/745 |
| 5,996,698 | A | 12/1999 | Behney | |
| 6,138,884 | A * | 10/2000 | Gish | 225/1 |
| 6,349,479 | B1 * | 2/2002 | Bottega | 33/481 |
| 6,543,141 | B1 * | 4/2003 | Biehl | 30/289 |
| 6,662,458 | B1 | 12/2003 | Antonelli | |
| 6,925,724 | B2 | 8/2005 | Tandy | |
| 7,100,295 | B1 | 9/2006 | Chang | |
| 7,219,440 | B2 * | 5/2007 | Lewis et al. | 33/760 |

(Continued)

FOREIGN PATENT DOCUMENTS

| | | |
|---|---|---|
| EP | 0 247 217 | 12/1987 |
| GB | 2 098 108 | 5/1981 |
| WO | WO 2004/092473 | 10/2004 |

OTHER PUBLICATIONS

Diamond Sharpening Products, Abrasive Products, Sharpening Products, catalog, p. 353.

(Continued)

*Primary Examiner* — Christopher W Fulton
(74) *Attorney, Agent, or Firm* — Robert L. Marsh

(57) ABSTRACT

A ruler has a body with a forward surface and a side surface defining a straight line. An elongate member having an abrasive outer edge is positioned along the side surface. The abrasive edge assists in sharpening a cutting tool moved along the edge.

7 Claims, 2 Drawing Sheets

U.S. PATENT DOCUMENTS

| | | | |
|---|---|---|---|
| 7,238,096 | B2 | 7/2007 | Scott |
| 7,568,295 | B1 | 8/2009 | Strain |
| D601,442 | S | 10/2009 | Haren |
| 2003/0110653 | A1 | 6/2003 | Schafer |
| 2007/0054604 | A1 | 3/2007 | Scott |
| 2007/0214671 | A1 | 9/2007 | Campagna |
| 2008/0171175 | A1 | 7/2008 | Park |
| 2009/0158602 | A1 | 6/2009 | Lockyer |

OTHER PUBLICATIONS

OLFA Cutting Mats & Quilt Rulers.
S & CA (Sewing and Craft Alliance) Quilting Rulers, 9.205, pp. 1-2, Sep. 2009.
United Notions, Rotary Cutters & Accessories catalog, pp. 208-214.
USA Sharpeners, Instructions—45mm and 60mm Orbital Sharpeners, pp. 1-2, Apr. 2009.

* cited by examiner

RULER WITH ABRASIVE EDGE

The applicant claims priority from his provisional application filed Jul. 14, 2009 and assigned Ser. No. 61/225,413 and is a continuation-in-part of my application filed Dec. 21, 2009 and assigned Ser. No. 12/643,416 now abandoned. The present invention relates to a ruler of the type used for cutting fabric and in particular a ruler having an abrasive edge for sharpening a fabric cutter.

BACKGROUND OF THE INVENTION

The fabric industry employs a rotary cutter to cut fabric to desired shapes and sizes. Many of the cuts made with the rotary cutter are required to be linear and a straight edge or ruler is used to guide the blade as the cut is made. The blade for such rotary cutters are expensive, and therefore to reduce the damage to the blade as it cuts fabric is it common to employ a resilient pad below the fabric. Nonetheless, the blades become dull over time and must ultimately be replaced.

One of the most important tools employed in the fabric industry is a ruler or straight edge for guiding the blade as it undertakes a linear cut. It is desirable, when making linear cuts in fabric, that the cut be without notches of indentations because such irregularities in the edges effect the usefulness of the panels of material on both sides of the cut. Accordingly, many of the cuts are made using a fabric ruler which is typically rectangularly shaped or square shaped, that is having two sets of parallel opposing sides with the sets perpendicular to each other and having planar forward and rearward surfaces.

It would be desirable to have an improved ruler for the fabric industry that would, in addition to providing a guide for undertaking a straight cut, aid in the sharpening the blade of a rotary cutter.

SUMMARY OF THE INVENTION

The present invention is embodied in a ruler comprising a body having planar rearward and forward surfaces and at least one side surface, with the side surface defining a straight line. A plurality of dimensional markings are provided on the forward surface along the side surface.

The ruler also has an elongate member extending along the side surface having an abrasive outer edge. In the preferred embodiment, the elongate member is made of a metal and the abrasive edge is made of a suitable hard material such as diamond powder.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENT

Figure 1:
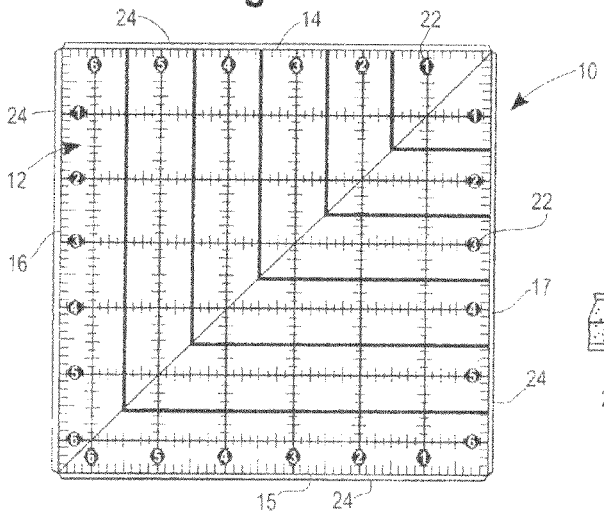
FIG. 1 is a front elevational view of a ruler in accordance with the present invention.

Referring to FIG. 1, a ruler 10 in accordance with the present invention has a generally planar body 12 made of a rigid material such as wood or plastic with the edges of the body 12 being generally rectangular, although it is preferably shaped as a square as depicted and having first and second opposing parallel sides 14, 15 and perpendicular thereto third and fourth parallel sides 16, 17. The body 12 also has a planar upper surface 18 and a planar lower surface 20. The sides 14-17 are all generally planar and perpendicular to the upper surface 18 such that they define straight edges to the upper surface 18.

Figure 5:
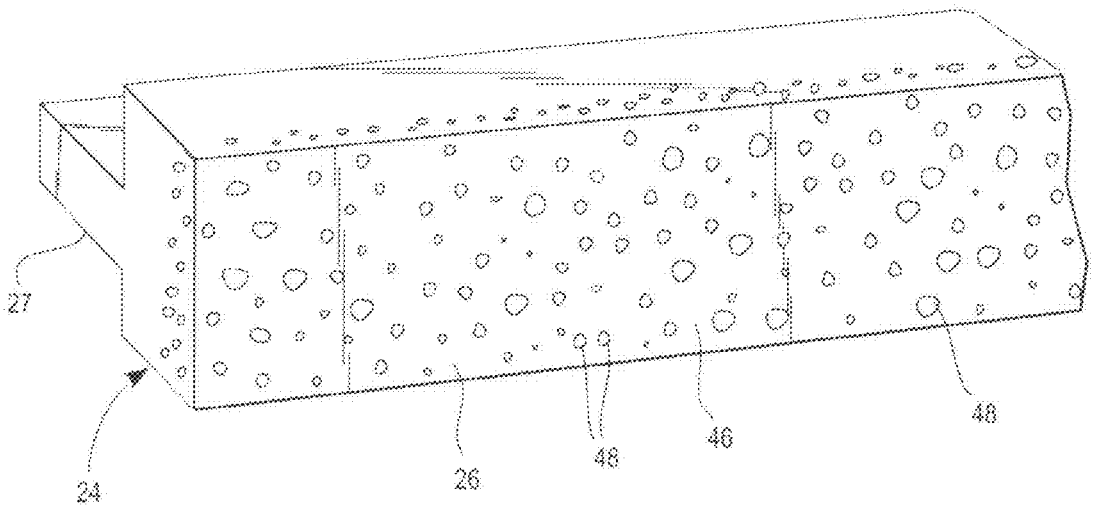
FIG. 5 is a further enlarged cross-sectional view of the edge of the ruler shown in FIG. 1 in which abrasive particles are visible.

Positioned on the upper surface 18 along each of the four sides 14-17 are dimensional markings 22. Extending along one of the sides 14, and preferably along all four of the sides, 14-17, is an elongate generally linear rigid member 24. The elongate member 24 is preferably made of metal and having an abrasive outer surface 26. As shown in FIG. 5, in the preferred embodiment the surface 26 is formed by impregnating the material 46 of which the member 24 is made with a diamond powder 48 or the like. It should be appreciated that it is desirable for a quilting ruler to provide measurements that begin from both the left and the right sides of the ruler, and to provide a scale that begins either at the edge of the ruler, or offset from the edge. As a result, it is desirable for the ruler 10 to have dimensional markings and provide a cutting edge along all four sides of the ruler 10.

Figure 2:
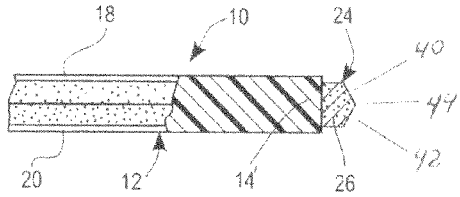
FIG. 2 is an enlarged cross-sectional side view of the ruler shown in FIG. 1.
Figure 4:
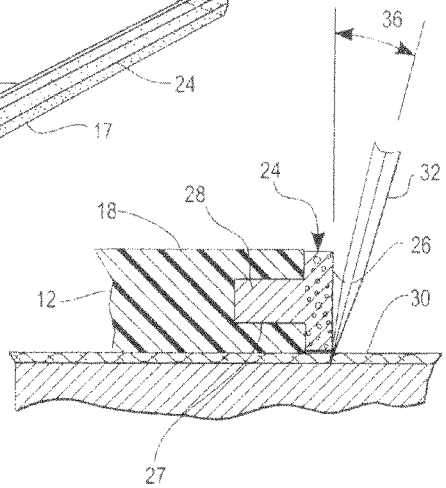
FIG. 4 is an enlarged end-on view of the blade of a rotary cutter moving along the edge of the ruler shown in FIG. 1.

As shown in FIG. 2, the elongate member 24 may be retained to the side 14 of the ruler 10 by any suitable means such as bonding the member 24 to the surface 14 with an adhesive, not shown, or as shown in FIG. 4, by providing an elongate groove 28 into the surface 14 with an elongate edge 38 of the member 24 received into the groove 28.

Figure 3:
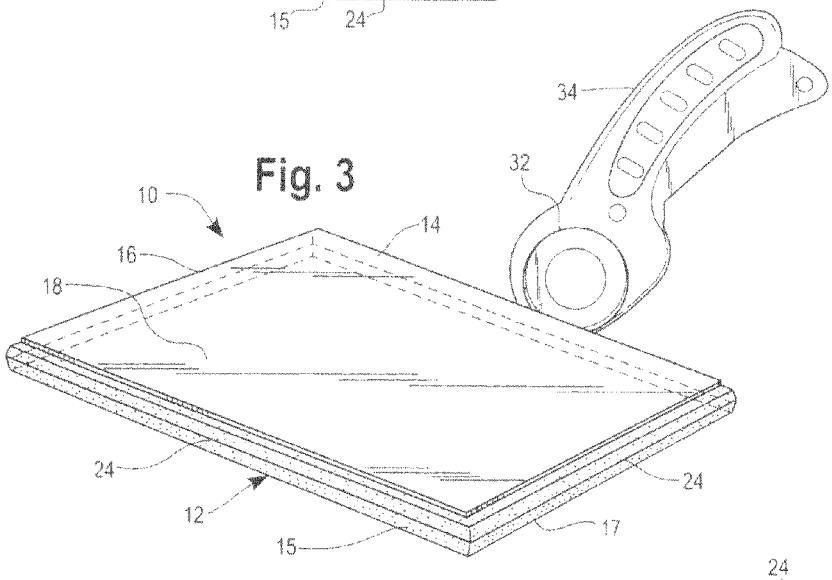
FIG. 3 is an isometric view of the ruler being used with a rotary cutter.

Referring to FIGS. 3, 4, and 5, when the ruler 10 is used to cut a panel of fabric 30, a rotary blade 32 mounted in a handle 34 is used to cut along the outer surface 26 of the linear member 24 of the ruler 10. As best seen in FIG. 4, when the rotary blade 32 is held at an angle 36 with respect to the outer surface 26 of the elongate member 24, a portion of the sharpened edge of the blade 32 will contact the surface 26 of the elongate member 24. As the edge of the blade 32 moves across the abrasive surface 26 of elongate member 24, the blade 32 will be sharpened thereby enhancing the useful life of the blade 32.

It should be appreciated that the elongate linear rigid member 24 may have many cross-sectional configurations. For example, the attachment edge 38 that joins the member 24 to one of the sides 14 of the ruler body 12 may be contoured or constricted into a tongue 27 as depicted in FIG. 4 so as to be received in a complementary groove 28. Alternately, it may be planar as depicted in FIG. 2 so as to abut a planar side surface 14' of the ruler 12. Similarly, the abrasive outer edge 26 may be generally planar as depicted in FIG. 4. Alternatively, the outer edge may be contoured when view in cross-section as shown in FIG. 2 and have converging angled surfaces 40, 42 that intersect each other and form an abrasive edge 44.

It should therefore be appreciated that many modifications and variations may be made without departing from the spirit of the present invention. It is therefore the intent of the appended claims to cover all such modifications and variations that fall within the spirit and scope of the invention.

What is claimed:

1. A ruler comprising:

a body having a rearward surface, a forward surface, and a side surface, a plurality of dimensional markings on said forward surface and adjacent said side surface, said side surface defining a straight edge to said forward surface, an elongate member along said side surface, and said elongate member having an abrasive outer edge.

2. The ruler of claim 1 wherein said side surface has a longitudinal groove therein, and said elongate member has a tongue inserted in said groove.

3. The ruler of claim 1 wherein said outer edge has angled side surfaces that converges to form an abrasive edge.

4. The ruler of claim 1 wherein the material of said elongate member is impregnated with diamond particles.

5. The ruler of claim 1 wherein said body has a second side surface perpendicular to said side surface and said ruler further comprises:

a second plurality of dimensional markings on said forward surface and adjacent said second side surface, said second side surface defining a straight edge to said forward surface, a second elongate member along said second side surface, and said second elongate member having an abrasive outer edge.

6. The ruler of claim 1 wherein said body has a second side surface parallel to said side surface and said ruler further comprises:

a second plurality of dimensional markings on said forward surface and adjacent said second side surface, said second side surface defining a straight edge to said forward surface, a second elongate member along said second side surface, and said second elongate member having an abrasive outer edge.

7. The ruler of claim 1 wherein said body has a second side surface perpendicular to said side surface, said body further has a third side surface parallel to said side surfaces, a second plurality of dimensional markings on said forward surface and adjacent said second side surface, said second side surface defining a straight edge to said forward surface, an second elongate member along said second side surface, said second elongate member having an abrasive outer edge, a third plurality of dimensional markings on said forward surface and adjacent said third side surface, said third side surface defining a straight edge to said forward surface, a third elongate member along said side surface, and said third elongate member having an abrasive outer edge.

* * * * *